United States Patent [19]

Gudish

[11] 4,051,564

[45] Oct. 4, 1977

[54] PORTABLE CONVERTIBLE SOFA-BUNK BEDS

[76] Inventor: Anthony Gudish, 2822 Dalemead St., Torrance, Calif. 90505

[21] Appl. No.: 735,585

[22] Filed: Oct. 26, 1976

[51] Int. Cl.[2] ..... A47C 17/16

[52] U.S. Cl. ..... 5/9 R; 5/8

[58] Field of Search ..... 5/8, 9 R, 9 B, 16, 18 R

[56] References Cited

U.S. PATENT DOCUMENTS

| | | | |
|---|---|---|---|
| 3,027,571 | 4/1962 | Bendixen et al. | 5/9 R |
| 3,310,815 | 3/1967 | Griffin | 5/9 R |
| 3,863,280 | 2/1975 | Mizelle | 5/9 R |

FOREIGN PATENT DOCUMENTS

| | | | |
|---|---|---|---|
| 1,410,440 | 10/1975 | United Kingdom | 5/8 |

*Primary Examiner*—Peter M. Caun

*Attorney, Agent, or Firm*—William I. Beach

[57] ABSTRACT

A portable sofa is convertible to a lower and upper tiered bed. The sofa includes a seat and a backrest structure which comprises two bed-forming members. The bed-forming members are arranged to be raised to form an upper bed above the seat and lower bed. The portable sofa provides sitting and sleeping accommodations for a home or recreational vehicles.

15 Claims, 6 Drawing Figures

PORTABLE CONVERTIBLE SOFA-BUNK BEDS

BACKGROUND OF THE INVENTION

1. Field of the Invention

The present invention relates to convertible sofas which can be converted into a bed and more particularly that which can be converted into a lower and upper bed structure.

2. Description of the Prior Art

The convertible sofas available today consist generally of the lower bed type which have a seat and backrest member arranged to fold up and move apart into a side by side lower bed. Some operate with the seat movable on slide members engaged in guided tracks to move forward while the backrest is movable by linkage members attached to the seat frame. This type of convertible sofa is normally used where floor space is not limited and the bed can be stretched out to clear wall structure furniture and the like. In the event that floor space is critical such as it is in the rear end of a motor van, for example, or a small bedroom it becomes a real problem to provide adequate bed space in such tight or cramped quarters. A built-in stationary upper and lower bunk structure may suffice in some instances but for the van, motor home or bedroom it is usually desirable to supplement the obvious bunk bed arrangement with a convertible sofa, couch, settee or a similar sitting room piece of furniture. On the other hand, to install a sofa which can be converted into a lower and upper bed in the limited space between the side walls of a van presents a real problem. A sofa consisting primarily of a seat and backrest structure does not normally include sufficient framework to house an internal linkage system required to raise the backrest structure high enough to make up an upper bed. Since this real problem continues to exist most attempts to solve the problem have resulted in essentially built-in types of convertible sofas which primarily rely on the side walls of the van to support and provide a part of the linkage system.

A settee-bed with backrest convertible to an upper bed is shown in U.S. Pat. No. 3,863,280 issued to Ned W. Minzelle which claims a settee mounted between fixed structural members at the head and foot of the bed. The fixed structural members in this device are fixed securely to the opposite side walls of the van. Further, the backrest structure is carried on brackets which are connected to the two structural members with the forward backrest member being part of a four bar linkage that is pivoted to the bracket. In raising to an upper level the forward backrest part swings up to a horizontal position in which it is against the rear wall of the van. At the same time the rearward backrest member which is suspended from a pair of hanger links swings forwardly underneath the forward backrest member and into upper bed position coplanar with the first backrest member.

The Mizelle device is essentially a built-in settee which pivots about upper and lower pivot connections on structural members secured to the side walls of a housing such as the rear end of a van. Accordingly, including the structural members, brackets and related linkage members being externally operated at the head and foot of the settee the hinged backrest members are raised to an upper bed position. In the raised upper bed position the backrest members are cantilever supported by the four bar linkage pivotably connected to the wall supported structural members. Therefore, with the weight of the sleeper applied on the upper bed the load is distributed in the form of tensile and compression stresses through the linkage to the side walls of the van rather than to the framework of the settee. Further, it appears that the Mizelle settee is largely custom made for the dimensions of the settee; linkage and structural members must be accurately established to conform to the inside space criteria of recreational vehicles. Since the Mizelle settee is not adjustable or portable it is somewhat limited in application to the recreational vehicle of a given class and does not adapt at all to a typical den or boys bedroom.

Another device similar to Mizelle's settee is shown in U.S. Pat. No. 3,311,932 issued to E. E. Ahola which discloses a berth-settee combination having a lower bunk fixed horizontally between opposite side walls of a housing again such as is found inside of a van. Ahola's settee comprises a backrest member which is equipped at each end with a forwardly disposed roller and a rearwardly disposed roller. There is a track attached to each of the opposite side walls and extending substantially horizontally thereacross and containing the corresponding forwardly disposed roller for support and guided travel. A second track is attached to each wall in a vertical directon and containing the rearwardly disposed roller therein for guided travel. The backrest member is then guided by its end roller in the horizontal and vertical tracks and raised from settee position to an upper bed position. Here again, Ahola's berth-settee is a built-in custom made structure and will not lend itself to wide usage.

In light of the above referenced prior art it is the object of the present invention to provide a portable sofa which will solve the aformentioned problems. The present invention is operably self-structured and independent of exterior structural support. The linkage means is confined within the framework of the sofa and structurally sufficient to support a heavy load applied on the upper bed and transfer the compression stresses resulting therefrom to the lower seat supporting structure. It can be manufactured readily and inexpensively with simple but effective means for converting a portable sofa into a lower and upper tiered bed structure. The present invention is adaptable to virtually all type of recreational vehicles as well as residential usage.

SUMMARY OF THE INVENTION

In carrying out the principles of the present invention in accordance with a preferred embodiment thereof, a portable sofa is adapted to be converted into a lower and upper bed. The sofa has a seat structure comprising a front, rear and opposite end portions which are arranged for a lower bed. An upright structure has an upper side and a lower side fixedly mounted on the rear portion of the seat structure. Disposed adjacent to the seat structure is a first forwardly inclining backrest structure which has a lower side and upper side pivotably connected to the upper side of the upright structure. Included is first hinge means provided to rotate the first backrest structure about the upper side of the upright structure. A second forwardly inclining backrest structure which has a lower side, an upper side and opposite ends is positioned behind and along side the first backrest structure with the lower side pivotably connected to the lower side of the first backrest structure. Included also is second hinge means provided to rotate the second backrest structure about the lower side of the first backrest structure. Attached to the opposite ends are a pair of spaced apart, elongate arms which have a lower pivotal connection at approximately two-thirds of the distance from the rear to the front portion of the seat structure and an upper pivotal connection to the opposite ends adjacent the upper side of the second backrest structure. In combination with the elongate arms and the first and second backrest structures linkage means are disposed to raise and support said structures to an upper, side by side coplanar bed position.

DETAILED DESCRIPTION OF THE PRESENT INVENTION

Figure 1:
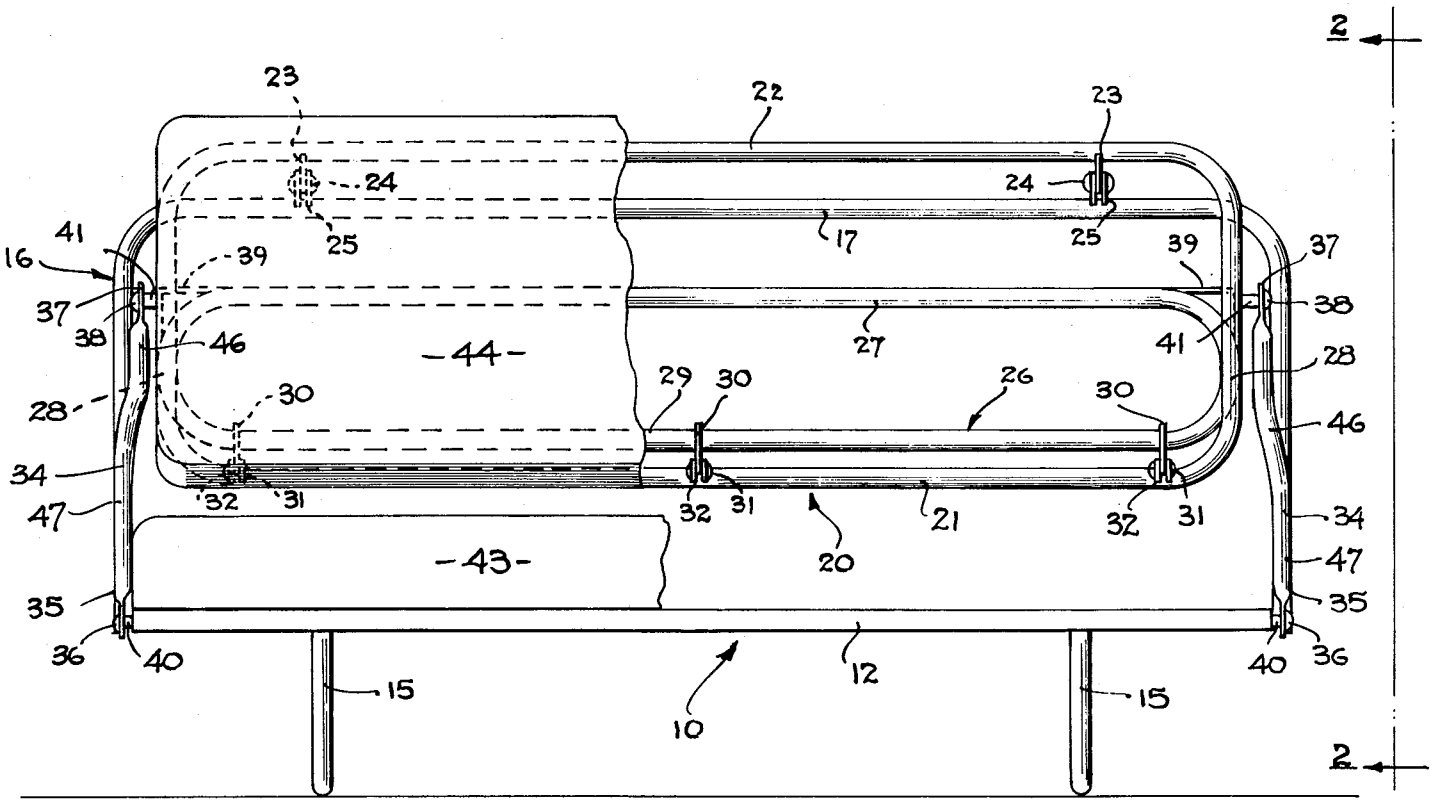
FIG. 1 is a front elevational view of the structural framework of the present invention.
Figure 2:
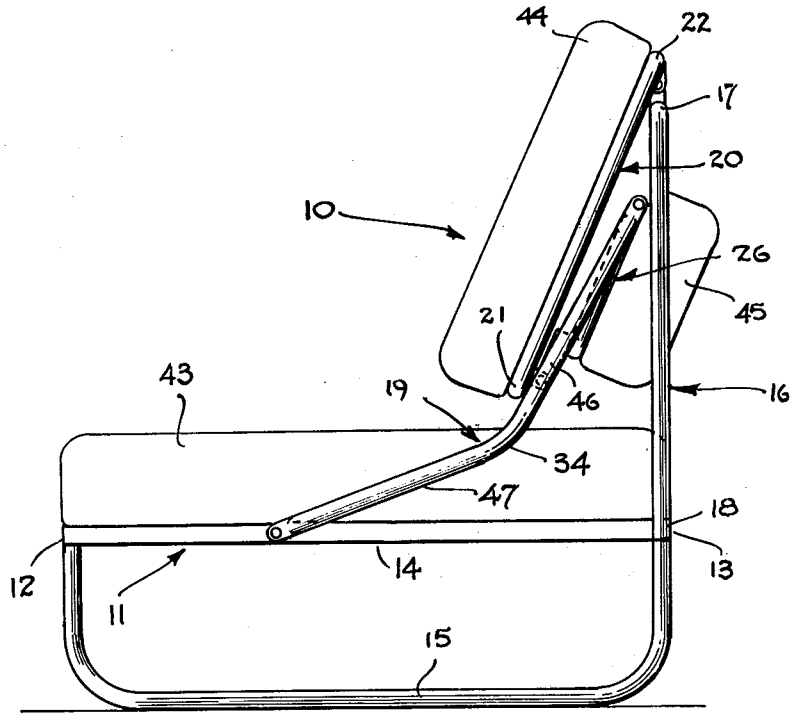
FIG. 2 is a side elevational view of FIG. 1 taken along side line 2-2 showing the first and second backrest frames disposed in normal backrest position.
Figure 6:
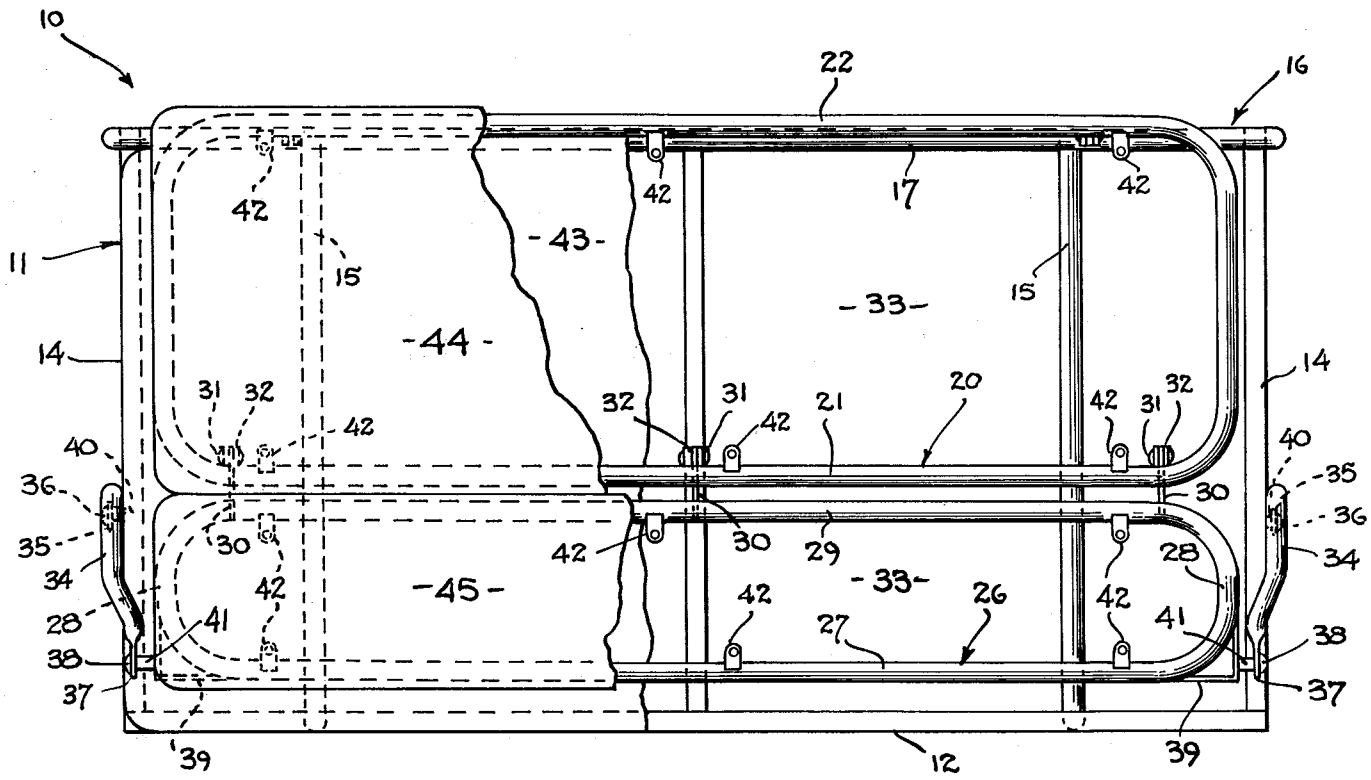
FIG. 6 is a top plan view of FIG. 5 taken along line 6—6.

Referring to FIG. 1, 2 and 6 it can be seen that a portable sofa 10 includes a rectangular seat frame 11 consisting of a front portion 12, a rear portion 13 and opposite ends 14. Seat frame 11 is supported on a pair of spaced apart seat mounts 15 which are attached at their upper ends to front portion 12 and rear portion 13. Also, fixedly attached to seat frame 11 is an upright supporting frame 16 which has an upper side 17 and a lower side 18 secured to rear portion 13 of seat 11.

Disposed in a forwardly inclining backrest position 19 above seat frame 11 is a first backrest frame 20 which has a lower side 21 and an upper side 22 rotatably secured to upper side 17 of upright supporting frame 16. The rotation of first backrest frame 20 about the upright supporting frame 16 is achieved by a plurality of hinge bars 23 which has one end rotatably connected by pin 24 in clevis member 25 fixedly secured to upper side 22 of first backrest frame 20 and the other end fixedly secured to upper side 17 of upright supporting frame 16 and extending outwardly and rearwardly approximately normal to the plane of first backrest frame 20. It is to be made clear that hinge bar 23 is selectively positioned so as to coordinate the relative moment arms of the elongate arms and the first and second backrest frames with respect to their pivotal connections. Preferably two of hinge bar 23 is sufficient for rotating first backrest frame 20 about upright supporting frame 16.

Positioned behind and along side first backrest frame 20 is a second backrest frame 26 which has an upper side 27, opposite ends 28 and a lower side 29 rotatably mounted on lower side 21 of first backrest frame 20. The rotation of second backrest frame 26 is provided by preferably three hinge bars 30 which have one end fixedly secured to the lower side 29 and extending outwardly parallel to the plane of the second backrest frame 26 and the other end rotatably connected by pin 31 in clevis member 32 fixedly secured to the lower side 21 of first backrest frame 20.

Figure 5:
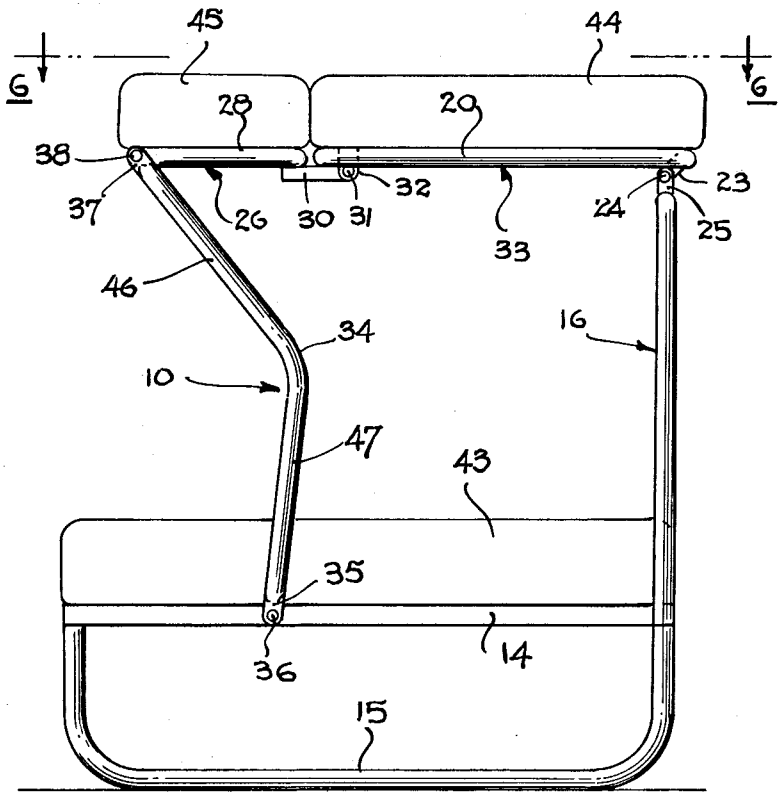
FIG. 5 is yet another side elevational view of FIG. 2 showing the first and second backrest frames rotated to an upper, side by side, coplanar bed position.

The means for rotatably supporting the first and second backrest members in movement from a backrest position 19 to an upper bed rest position 33 as shown in FIG. 2, 5 and 6, is provided by a pair of spaced apart, L-shaped arms 34 which have a lower end 35 rotatably connected by pin 36 to ends 14 adjacent front portion 12 of seat frame 11 and an upper end 37 rotatably connected by pin 38 to bracket 39 fixedly secured to ends 28 adjacent the upper side 27 of second backrest frame 26. Pins 36 and 38 are housed in spacer bushings 40 and 41 respectively.

The construction of the present invention is preferably an assembly of metal framework and cooperating parts. For example, the first and second backrest frames 20 and 26, upright supporting frame 11, seat mounts 15 and the pair of elongate arms 34 are formed of metal tubing. On the other hand, so as to provide strength and rigidity as well as to facilitate the manufacture of the portable sofa 10, the seat frame is formed of U-shaped metal channel. Fixedly secured to the front and rear portions of seat frame 11 and the upper and lower sides of backrest frames 20 and 26 are a plurality of metal attachment tabs 42 extending inwardly parallel to the plane of said frames. Secured to metal tabs 42 is a suitable panel, preferably plywood, which is shaped to the framework of frames 11, 20 and 26 respectively. The panels, not shown in the drawing, are then covered with cushion 43 on seat frame 11, 44 on first backrest frame 20 and cushion 45 on second backrest frame 26. While tabs 23 are desirable to provide a simple and efficient base for supporting seat and backrest cushions it is to be understood that other upholstery supporting means are available. For example, the cushions can be encased in a box structure which may be fastened to the framework. Likewise, the panel may be replaced with webbing or bed springs secured to the seat and backrest frames.

Further, it is seen that the pair of elongate arms 34 are formed in a simulated L-shaped configuration which comprised an upper length 46 and a lower length 47. Referring to FIG. 2, the first and second backrest frames 20 and 26 are shown in a backrest inclined position over seat frame 11 and it can be seen that the upper length 46 is disposed along side backrest frame 20 and behind the forward face of cushion 44. Likewise, lower length 47 is disposed along side seat frame 11 and below the top of cushion 43. Thus, when sofa 10 is in backrest position 19, arms 34 do not protrude beyond the outer surface of cushions 43 and 44 so as to interfere with the movement of a person sitting thereupon.

Figure 3:
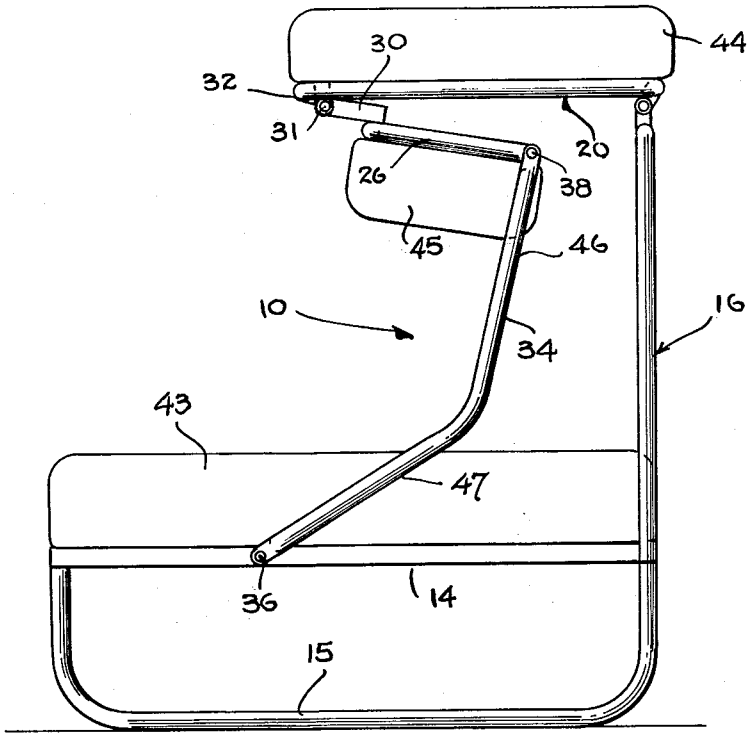
FIG. 3 is another side elevational view of FIG. 2 showing the first backrest frame rotated to a horizontal position and the second backrest frame starting to rotate forwardly.
Figure 4:
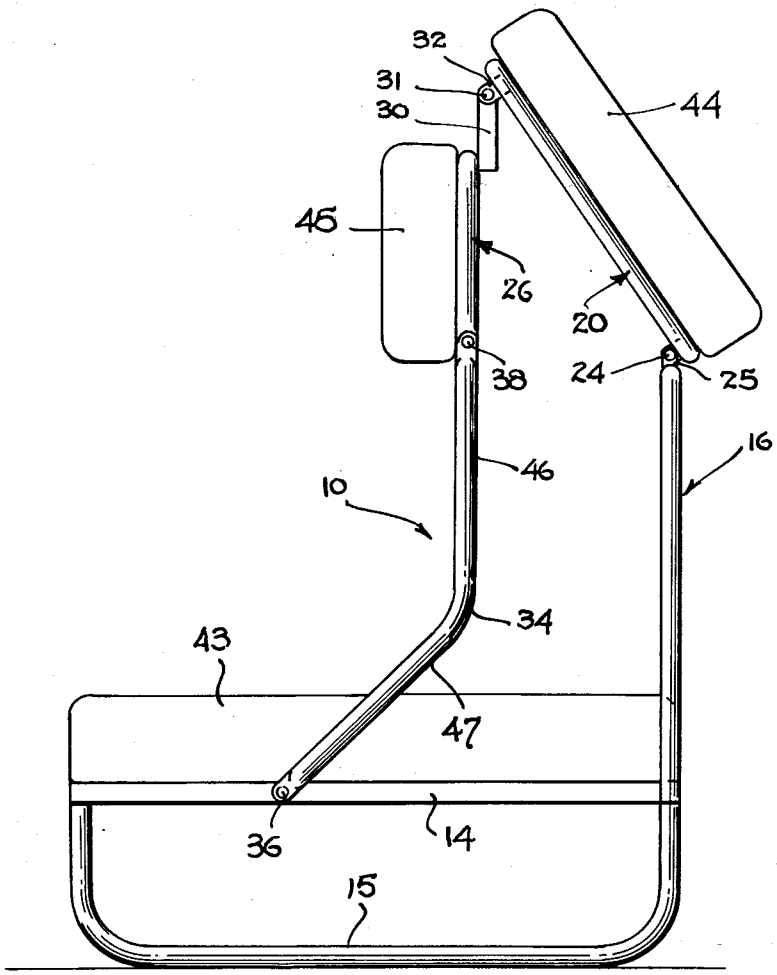
FIG. 4 is another side elevational view of FIG. 2 showing the first backrest frame rotated upwardly at maximum height and the second backrest frame rotated to vertical position.

The unique construction of the present invention lends itself readily to simple means for converting sofa 10 from a backrest position to an upper bed position. Requiring minimum effort to operate the mechanism of sofa 10, the operator merely grasps the lower side 21 of first backrest frame 20, as shown in FIG. 2, and swings it upwardly to a horizontal position, reference FIG. 3, whereupon the second backrest frame 26 starts to rotate forwardly. Then continuing to swing the frames upwardly to the maximum extendible height, as shown in FIG. 4, the first backrest frame 20 is rotated upwardly to an inclined angle with the horizontal and the second backrest frame is rotated to a vertical position. Then the operator shifts his hold and grasps the upper side 27 of second backrest frame 26 and pulls the frame downwardly and forwardly until the first and second backrest frames are brought in side by side, coplanar, upper bed position as illustrated in FIG. 5 and 6.

From the description and illustration of the present invention it is obvious that it provides many important advantages which can be used effectively and efficiently to convert a sofa into a lower and upper tiered bed.

The foregoing description is to be clearly understood to be given by way of illustration and example only, the spirit and scope of the present invention being limited solely by the appended claims.

I claim:

1. A portable sofa adapted to be converted into a lower and upper tiered bed, which comprises:

a seat structure having a front, rear and opposite end portions adapted to be made into a lower bed, an upright structure having an upper and lower side, the lower side being mounted on the rear portion of the seat structure, a first forwardly inclining backrest structure disposed in backrest position on said seat structure and having a lower side and an upper side pivotably connected to the upper side of the upright structure, first hinge means adapted to rotate the first backrest structure about the upper side of said upright structure, a second forwardly inclining backrest structure having a lower side, an upper side and opposite ends disposed behind and along side of said first backrest structure, the lower side being pivotably connected to the lower side of said first backrest structure, second hinge means adapted to rotate the second backrest structure about the lower side of said first backrest structure, a pair of spaced apart elongate arms having a lower pivotal connection to the opposite ends of said seat structure at approximately two-thirds of the distance from the rear to the front portion of said seat structure and an upper pivotal connection to the opposite ends adjacent the upper side of said second backrest structure, and linkage means, in combination with the elongate arms and said first and second backrest structures, adapted to raise and support said structures to an upper side to side, coplanar bed position.

2. A portable sofa as recited in claim 1, wherein:

the first hinge means comprises at least two spaced apart hinge bars having one end rotatably secured to said upper side of said first backrest structure and the other end rotatably secured to said upper side of said upright structure.

3. A portable sofa as recited in claim 1, wherein:

the second hinge means comprised at least two spaced apart hinge bars having one end rigidly secured to said lower side of said second backrest structure and the other end rotatably secured to said lower side of said first backrest structure.

4. A portable sofa as recited in claim 1, wherein:

said seat structure and said first and second backrest structures further include cushion members secured thereto.

5. A convertible sofa adapted to be made into a lower and upper tiered bed, which comprises:

a seat frame having a front, rear and opposite end portions, the seat frame being arranged for a lower bed, a seat mount adapted to support said seat frame, an upright upper bed supporting frame having an upper and lower side, the lower side being fixedly mounted on the rear portion of said seat frame, a first forwardly inclining upper bed frame having a lower side and an upper side pivotably connected to the upper side of the upright supporting frame, the first bed frame being disposed in a backrest position on said seat frame, first hinge means arranged to rotate said first bed frame about the upper side of said upright supporting frame, a second forwardly inclining upper bed frame having a lower side, an upper side and opposite ends disposed behind and along side of said first bed frame and having the lower side pivotably connected to a lower side of said first bed frame, a second hinge means arranged to rotate said second bed frame about the lower side of said first bed frame, a pair of spaced apart elongate arms having a lower pivotal connection to the opposite ends of said seat frame approximately two-thirds of the distance from the rear portion to the front portion of said seat frame and an upper pivotal connection to the opposite ends of said second bed frame adjacent the upper side thereof, and linkage means, in cooperation with the elongate arms and said first and second bed frames, adapted to raise and support said first and second bed frames to an upper position directly over said seat frame by rotating said first bed frame about said upper side of said upright supporting frame and said second bed frame about said lower side of said first bed frame so as to bring said first and second bed frames in side to side, coplanar upper bed position.

6. A convertible sofa as recited in claim 5, wherein:

said seat frame, said first and second bed frames and said upright supporting frame are substantially rectangular metal frames having a plurality of metal attachment tabs along the front and rear sides of said seat and said first and second bed frames, the tabs extending inwardly parallel to the plane of each of said frames.

7. A convertible sofa as recited in claim 5, wherein:

said seat mount includes a pair of spaced apart, U-shaped metal frames having the upper open ends of the vertical legs secured to said front and rear portions of said seat frame and the horizontal leg bearing on the floor.

8. A convertible sofa as recited in claim 6, wherein:

said seat frame and said first and second bed frames further include a panel secured to the tabs.

9. A convertible sofa as recited in claim 8, wherein:

said seat frame and said first and second bed frames include a cushion member secured to the panel on said frames.

10. A convertible sofa as recited in claim 5, wherein:

said first hinge means comprised at least two spaced apart metal hinge bars having one end fixedly connected to said upper side and extending outwardly and rearwardly approximately normal to the plane of said first bed frame and the other end rotatably pinned in clevis members fixedly connected to said upper side and extending outwardly parallel to the plane of said upright supporting frame.

11. A convertible sofa as recited in claim 10, wherein:

said second hinge means comprised at least two spaced apart metal hinge bars having one end fixedly connected to said lower side and extending outwardly parallel to the plane of said second bed frame and the other end rotatably pinned in clevis members fixedly connected to said lower side and extending outwardly normal to the plane of said first bed frame, and hinge locking means arranged to lock first and second bed frames in horizontal upper bed position.

12. A convertible sofa as recited in claim 11, wherein:

said elongate arms are disposed so as to rotate and limit the upward travel of said first and second bed frames rotatating together along side each other about said upper side of said upright supporting frame to an interim position above said upper bed position, whence said second bed frame separates from along side of said first bed frame and rotates downwardly about said lower side of said first bed frame while said first bed frame reaches a maximum extending height whereupon said second bed frame rotates to a vertical position as said elongate arms rotates forwardly to a maximum extended arc and draws said first bed frame in a reverse downwardly rotation and said second bed frame downwardly and forwardly to bring said frames together in side to side, coplanar upper bed position.

13. A covertible sofa as recited in claim 12, wherein:

said hinge locking means comprises an interlocking connection exerted by the hinge bar between said first and second frames in end to end, coplanar upper bed position, said hinge bar being rigidly secured at one end to said second bed frame and extending rearwardly parallel to the plane of said first bed frame and having the other end rotatably wedged in the clevis member secured to said first frame so that said lower side of said first frame bears directly on said hinge bar to bridge the hinge connection therebetween and prevent said frames from collapsing downwardly under body weight applied thereon, and hinge unlocking means adapted to lower said first and second bed frames into backrest position on said seat frame.

14. A convertible sofa as recited in claim 13, wherein:

said hinge unlocking means includes raising said hinge connection between said first and second bed frames upwardly to the maximum extended height above said upper bed position until said second frame is rotated to vertical position and then pressing downwardly rearwardly to lower said frames in backrest position on said seat frame.

15. A convertible sofa as recited in claim 12, wherein:

said arms formed in an open L-shaped length so that when said first and second bed frames are in backrest position said arms have an upper length disposed along side of said ends of said first bed frame and behind the front face of the cushion thereon and a lower length disposed along side of said seat frame and below the top face of the cushion thereon.

* * * * *